US006560810B1

(12) United States Patent
Jacobson

(10) Patent No.: US 6,560,810 B1
(45) Date of Patent: May 13, 2003

(54) COLLAPSIBLE TOOTHBRUSH

(76) Inventor: Michael A. Jacobson, 9203 Melody Ct., Covington, GA (US) 30014

( * ) Notice: Subject to any disclaimer, the term of this patent is extended or adjusted under 35 U.S.C. 154(b) by 0 days.

(21) Appl. No.: 09/922,286

(22) Filed: Aug. 3, 2001

(51) Int. Cl.[7] ..... A46B 9/04; A46B 17/04
(52) U.S. Cl. ..... 15/185; 15/167.1
(58) Field of Search ..... 15/144.1, 144.3, 15/167.1, 184, 185

(56) References Cited

U.S. PATENT DOCUMENTS

| | | | | | |
|---|---|---|---|---|---|
| 766,247 | A | * | 8/1904 | Heilrath | 15/185 |
| 905,886 | A | * | 12/1908 | Kinney | 15/185 |
| 1,142,356 | A | | 6/1915 | Nellany | 15/185 |
| 1,296,186 | A | * | 3/1919 | Hines | 15/185 |
| 1,967,775 | A | * | 7/1934 | Kantor | 15/185 |
| 2,110,461 | A | * | 3/1938 | Chibnik | 15/185 |
| 2,216,026 | A | * | 9/1940 | Smith | 15/144.1 |
| 2,353,963 | A | * | 7/1944 | Landesman | 15/185 |
| 2,576,551 | A | * | 11/1951 | Waters | 15/167.1 X |
| 2,790,449 | A | * | 4/1957 | Hennings | 15/185 X |
| 3,769,991 | A | | 11/1973 | Mcgrath | 132/308 |
| 4,731,896 | A | | 3/1988 | de La Tour | 15/106 |
| D300,690 | S | | 4/1989 | Ambasz | D4/108 |
| 4,850,074 | A | * | 7/1989 | Klevan | 15/185 |
| D310,915 | S | * | 10/1990 | Ambasz | D4/108 |
| 4,979,258 | A | | 12/1990 | Buj | 15/167.1 |
| 5,090,080 | A | | 2/1992 | Thuresson et al. | 15/143.1 |
| 5,464,294 | A | * | 11/1995 | Chee et al. | 401/269 |
| 5,476,334 | A | * | 12/1995 | Tello-Vallarino | 401/268 |

FOREIGN PATENT DOCUMENTS

| | | | | |
|---|---|---|---|---|
| DE | 815966 | * | 10/1951 | 15/185 |
| FR | 788626 | * | 7/1935 | 15/185 |
| GB | 174874 | * | 2/1922 | 15/185 |

* cited by examiner

*Primary Examiner*—Mark Spisich

(57) ABSTRACT

A collapsible toothbrush includes a body member that has a first portion and a second portion. The first portion is pivotally coupled to the second portion such that the first portion is selectively positionable adjacent the second portion facilitating compact storage of the body member. The first portion has a plurality of bristles. The bristles are adapted to be rubbed against teeth of the user for cleaning the teeth of the user. The bristles are positioned opposite the second portion of the body member such that the body member is adapted for is held in a hand of the user when the bristles are used to clean the teeth of the user.

12 Claims, 2 Drawing Sheets

21
19
23
26
23
21
19
22
22
24
20

17
15
18
18
16
17
24
25

26
23
19
19
15
17

24
20
20
13

COLLAPSIBLE TOOTHBRUSH

BACKGROUND OF THE INVENTION

1. Field of the Invention

The present invention relates to collapsible toothbrushes and more particularly pertains to a new collapsible toothbrush for allowing a user conveniently have a reliable toothbrush on hand at all times while away from home.

2. Description of the Prior Art

The use of collapsible toothbrushes is known in the prior art. More specifically, collapsible toothbrushes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,850,074; 5,464,294; 5,476,334; 1,296,186; 2,110,461; and U.S. Pat. No. Des. 310,915.

While these devices fulfill their respective, particular objectives and requirements, the aforementioned patents do not disclose a new collapsible toothbrush. The inventive device includes a body member that has a first portion and a second portion. The first portion is pivotally coupled to the second portion such that the first portion is selectively positionable adjacent the second portion facilitating compact storage of the body member. The first portion has a plurality of bristles. The bristles are adapted to be rubbed against teeth of the user for cleaning the teeth of the user. The bristles are positioned opposite the second portion of the body member such that the body member is adapted for is held in a hand of the user when the bristles are used to clean the teeth of the user.

In these respects, the collapsible toothbrush according to the present invention substantially departs from the conventional concepts and designs of the prior art, and in so doing provides an apparatus primarily developed for the purpose of allowing a user conveniently have a reliable toothbrush on hand at all times while away from home.

SUMMARY OF THE INVENTION

In view of the foregoing disadvantages inherent in the known types of collapsible toothbrushes now present in the prior art, the present invention provides a new collapsible toothbrush construction wherein the same can be utilized for allowing a user conveniently have a reliable toothbrush on hand at all times while away from home.

The general purpose of the present invention, which will be described subsequently in greater detail, is to provide a new collapsible toothbrush apparatus and method which has many of the advantages of the collapsible toothbrushes mentioned heretofore and many novel features that result in a new collapsible toothbrush which is not anticipated, rendered obvious, suggested, or even implied by any of the prior art collapsible toothbrushes, either alone or in any combination thereof.

To attain this, the present invention generally comprises a body member that has a first portion and a second portion. The first portion is pivotally coupled to the second portion such that the first portion is selectively positionable adjacent the second portion facilitating compact storage of the body member. The first portion has a plurality of bristles. The bristles are adapted to be rubbed against teeth of the user for cleaning the teeth of the user. The bristles are positioned opposite the second portion of the body member such that the body member is adapted for is held in a hand of the user when the bristles are used to clean the teeth of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new collapsible toothbrush apparatus and method which has many of the advantages of the collapsible toothbrushes mentioned heretofore and many novel features that result in a new collapsible toothbrush which is not anticipated, rendered obvious, suggested, or even implied by any of the prior art collapsible toothbrushes, either alone or in any combination thereof.

It is another object of the present invention to provide a new collapsible toothbrush, which may be easily and efficiently manufactured and marketed.

It is a further object of the present invention to provide a new collapsible toothbrush, which is of a durable and reliable construction.

An even further object of the present invention is to provide a new collapsible toothbrush which is susceptible of a low cost of manufacture with regard to both materials and labor, and which accordingly is then susceptible of low prices of sale to the consuming public, thereby making such collapsible toothbrush economically available to the buying public.

Still yet another object of the present invention is to provide a new collapsible toothbrush, which provides in the apparatuses and methods of the prior art some of the advantages thereof, while simultaneously overcoming some of the disadvantages normally associated therewith.

Still another object of the present invention is to provide a new collapsible toothbrush for allowing a user conveniently have a reliable toothbrush on hand at all times while away from home.

Yet another object of the present invention is to provide a new collapsible toothbrush, which includes a body member that has a first portion and a second portion. The first portion is pivotally coupled to the second portion such that the first portion is selectively positionable adjacent the second portion facilitating compact storage of the body member. The first portion has a plurality of bristles. The bristles are adapted to be rubbed against teeth of the user for cleaning the teeth of the user. The bristles are positioned opposite the second portion of the body member such that the body member is adapted for is held in a hand of the user when the bristles are used to clean the teeth of the user.

Still yet another object of the present invention is to provide a new collapsible toothbrush that is easier to use and more durable that standard travel brushes that pull apart during use.

Even still another object of the present invention is to provide a new collapsible toothbrush that allows proper pressure to be applied to the handle, making it simpler to brush as thoroughly as possible.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
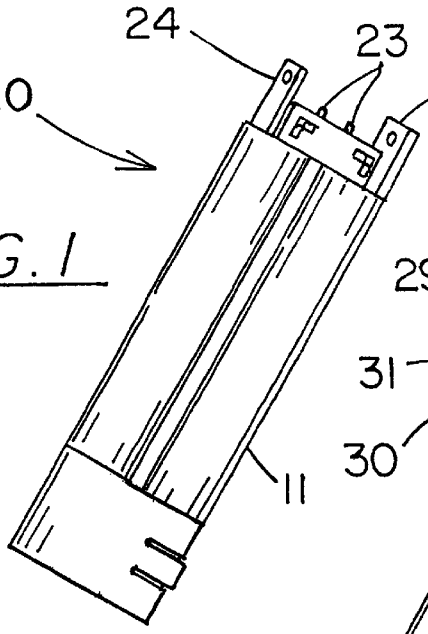
FIG. 1 is a side view of a new collapsible toothbrush according to the present invention.
Figure 2:
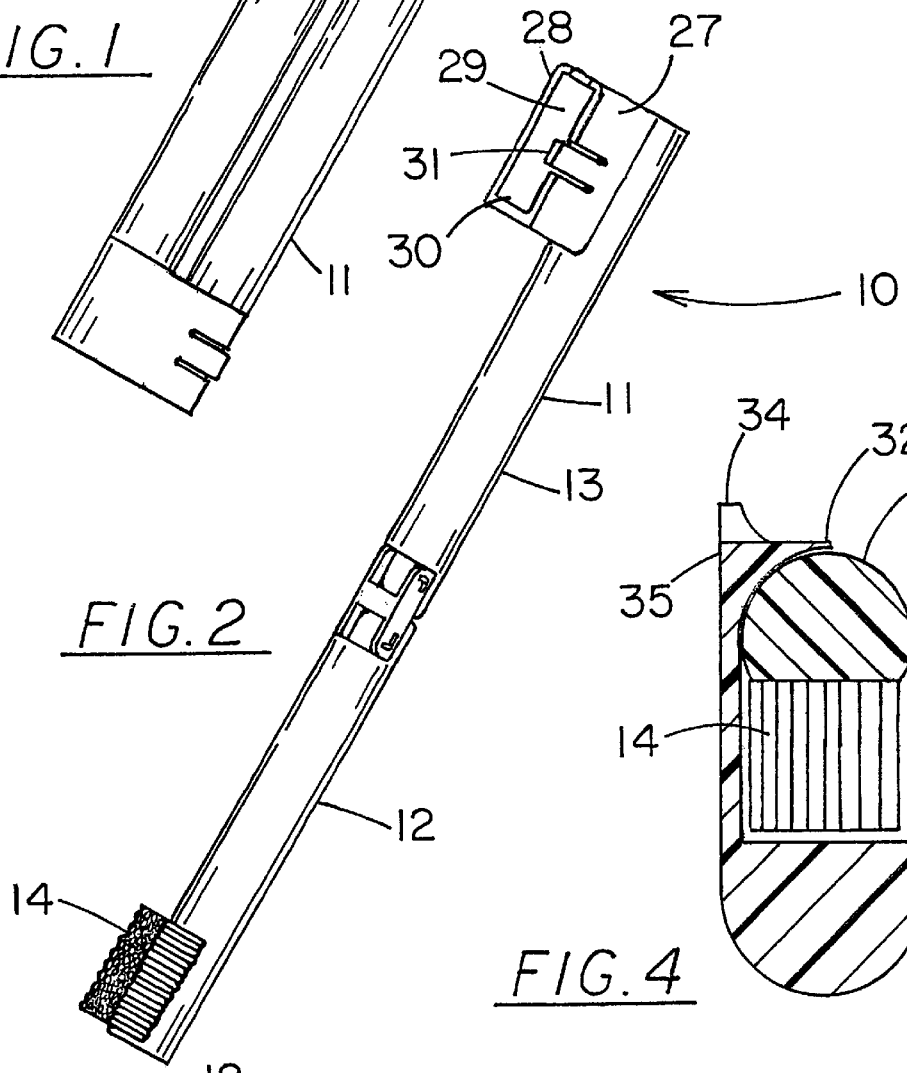
FIG. 2 is a perspective view of the present invention.
Figure 4:
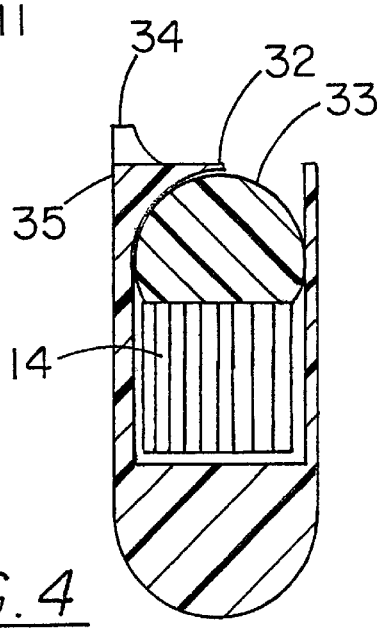
FIG. 4 is a cross-sectional view of the present invention.
Figure 3:
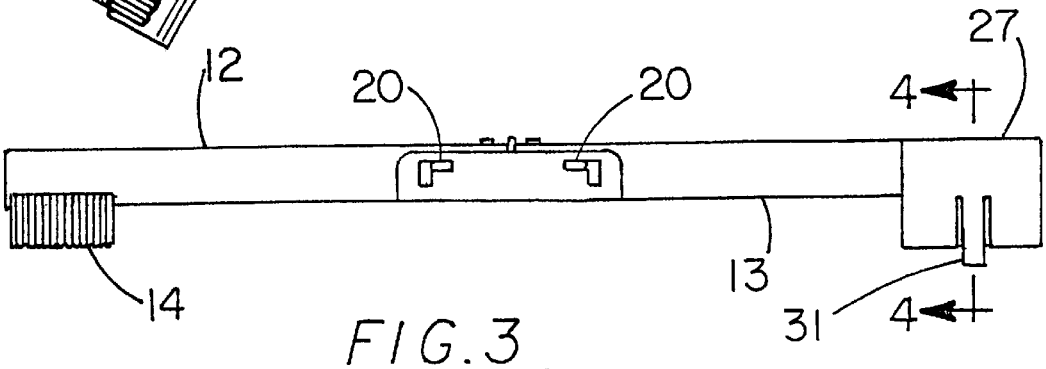
FIG. 3 is a side view of the present invention.
Figures 5, 6, 7, 8:
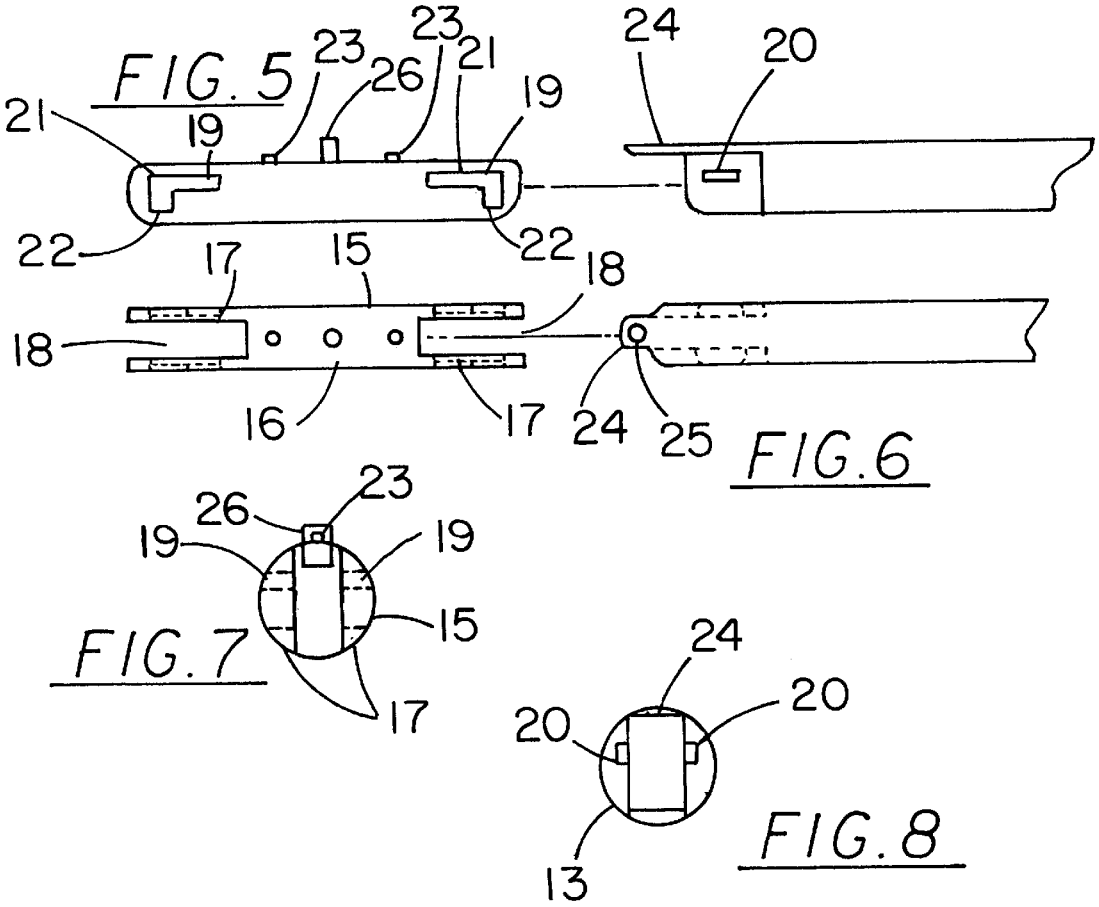
FIG. 5 is a side view of the present invention.
FIG. 6 is a side view of the present invention.
FIG. 7 is an end view of the present invention.
FIG. 8 is an end view of the present invention.

With reference now to the drawings, and in particular to FIGS. 1 through 8 thereof, a new collapsible toothbrush embodying the principles and concepts of the present invention and generally designated by the reference numeral 10 will be described.

As best illustrated in FIGS. 1 through 8, the collapsible toothbrush 10 generally includes a body member 11 that has a first portion 12 and a second portion 13. The first portion 12 is pivotally coupled to the second portion 13 such that the first portion 12 is selectively positionable adjacent the second portion 13 facilitating compact storage of the body member 11. The first portion 12 has a plurality of bristles 14. The bristles 14 are adapted to be rubbed against teeth of the user for cleaning the teeth of the user. The bristles 14 are positioned opposite the second portion 13 of the body member 11 such that the body member 11 is adapted to be held in a hand of the user when the bristles 14 are used to clean the teeth of the user.

A hinge member 15 is coupled between the first portion 12 of the body member 11 and the second portion 13 of the body member 11. The first portion 12 of the body member 11 is pivotally coupled to the hinge member 15. The second portion 13 of the body member 11 is pivotally coupled to the hinge member 15 such that the first portion 12 of the body member 11 is positionable adjacent the second portion 13 of the body member 11 when the first portion 12 and the second portion 13 of the body member 11 are pivoted with respect to the hinge member 15.

The hinge member 15 has a base portion 16 and a pair of sidewalls 17. The base portion 16 and the sidewalls 17 define a pair of channels 18. The first portion 12 of the body member 11 is pivotally coupled within one of the channels 18 of the hinge member 15. The second portion 13 of the body member 11 is pivotally coupled within one of the channels 18 of the hinge member 15. The side walls 17 of the hinge member 15 is for maintaining alignment of the first portion and the second portion of the body member when the first portion 12 and the second portion 13 are pivoted with respect to the hinge member 15.

Each of the sidewalls 17 of the hinge member 15 has a pair of guide slots 19. The first portion 12 and the second portion 13 of the body member 11 each have a pair of guide tabs 20. Each of the guide tabs 20 is received by one of the guide slots 19 such that the guide slots 19 are for guiding the first portion 12 and the second portion 13 of the body member 11 between an axially aligned position and an axially parallel position when the first portion 12 and the second portion 13 of the body member 11 are pivoted with respect to the hinge member 15.

Each of the guide slots 19 has an alignment portion 21 and a collapsed portion 22. The collapsed portion 22 is orthogonally positioned with respect to the alignment portion 21. Each of the guide tabs 20 is slidably positionable between the alignment portion 21 and the collapsed portion 22 of a respective one of the guide slots 19 such that the first portion 12 and the second portion 13 of the body member 11 are in the axially aligned position when the guide tabs 20 of the first portion 12 and the second portion 13 of the body member 11 are positioned in the alignment portion 21 of the guide slots 19. The first portion 12 and the second portion 13 of the body member 11 are in the axially parallel position when the guide tabs 20 of the first portion 12 and the second portion 13 of the body member 11 are positioned within the collapsed portion 22 of the guide slots 19.

The base portion 16 of the hinge member 15 has a pair of locking pins 23. The locking pins 23 are positioned between the channels 18 of the hinge member 15. The first portion 12 and the second portion 13 of the body member 11 each have a locking tab 24. The locking tab 24 of the first portion 12 and the second portion 13 of the body member 11 has a locking aperture 25. The locking aperture 25 of the locking tab 24 of the first portion 12 of the body member 11 is for receiving one of the locking pins 23 for securing the first portion 12 in the axially aligned position. The locking aperture 25 of the locking tab 24 of the second portion 13 of the body member 11 is for receiving one of the locking pins 23 for securing the second portion 13 in the axially aligned position such that the first portion 12 of the body member 11 is aligned with the second portion 12 of the body member 11 when the user grips the body member 11 for brushing the users teeth.

The hinge member 15 has a center pin 26. The center pin 26 is positioned between the locking pins 23 of the hinge member 15. The center pin 26 is adapted to be pushed upon by a finger of the user such that pushing of the center pin 26 facilitates disengaging the locking pins 23 for the-locking tabs 24 of the first portion 12 and the second portion 13 of the body member 11 when the first portion 12 and the second portion 13 of the body member 11 are pivoted to the axially parallel position.

The second portion 13 of the body member 11 has a cover member 27. The cover member 27 is positioned opposite the first portion 12 of the body member 11. The cover member 27 is for receiving and protecting the bristles 14 when the first portion 12 of the body member 11 is positioned adjacent the second portion 13 of the body member 11. The cover member 27 of the second portion 13 of the body member 11 has a perimeter wall 28. The perimeter wall 28 defines an interior cavity 29. The interior cavity 29 has an open top 30 for permitting insertion of the bristles 14 into the interior cavity 29 when the first portion 12 of the body member 11 is positioned adjacent the second portion 13 of the body member 11.

The cover member 27 of the second portion 13 of the body member 11 has a securing clip 31. The securing clip 31 is coupled to the perimeter wall 28. The securing clip 31 has a lip 32 that extends from an upper end of the securing clip 31. The lip 32 extends into the interior cavity 29 of the cover member 27. The lip 32 of the securing clip 31 is for engaging a rear face 33 of the first portion 12 of the body member 11 when the bristles 14 are inserted into the interior cavity 29 of the cover member 27 such that the securing clip 31 selectively secures the first portion 12 of the body member 11 to the second portion 13 of the of the body member 11 when the first portion 12 of the body member 11 is positioned adjacent to the second portion 13 of the body member 11.

The securing clip 31 of the cover member 27 has a finger tab 34. The finger tab 34 upwardly extends from the upper end 35 of the securing clip 31. The finger tab 34 is adapted for being engaged by the user such that the securing clip 31 is selectively bent away from the interior cavity 29 thereby removing the lip 32 of the securing clip 31 from the interior cavity 29 of the cover member 27 for facilitating removal the bristles 14 from the cover member 27.

In use, a user would release a built-in clip that rests atop the brushing head and cover. The toothbrush is then opened and pushed together until two incorporated tabs lock into place to ensure the brush is stable and ready for use. After the user has finished brushing, the tabs are lifted to release the locking component and the brush is folded over to lock the brushing head within the cap and cover.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible toothbrush for aiding oral hygiene of the user, the collapsible toothbrush comprising:

a body member having a first portion and a second portion, said first portion being pivotally coupled to said second portion such that said first portion is selectively positionable adjacent said second portion facilitating compact storage of said body member, said first portion having a plurality of bristles, said bristles being adapted for being rubbed against teeth of the user for cleaning the teeth of the user, said bristles being positioned opposite said second portion of said body member such that said body member is adapted for being held in a hand of the user when said bristles are used to clean the teeth of the user;

a hinge member being coupled between said first portion of said body member and said second portion of said body member, said first portion of said body member being pivotally coupled to said hinge member, said second portion of said body member being pivotally coupled to said hinge member such that said first portion of said body member is positionable adjacent said second portion of said body member when said first portion and said second portion of said body member are pivoted with respect to said hinge member; and said hinge member having a base portion and a pair of side walls, said base portion and said side walls defining a pair of channels, said first portion of said body member being pivotally coupled within one of said channels of said hinge member, said second portion of said body member being pivotally coupled within one of said channels of said hinge member, said side walls of said hinge member being for maintaining alignment of said first portion and said second portion of said body member when said first portion and said second portion are pivoted with respect to said hinge member.

2. The collapsible toothbrush as set forth in claim 1, further comprising:

each of said side walls of said hinge member having a pair of guide slots; and said first portion and said second portion of said body member each having a pair of guide tabs, each of said guide tabs being received by one of said guide slots receiving such that said guide slots are for guiding said first portion and said second portion of said body member between an axially aligned position and an axially parallel position when said first portion and said second portion of said body member are pivoted with respect to said hinge member.

3. The collapsible toothbrush as set forth in claim 2, further comprising:

each of said guide slots having a alignment portion and a collapsed portion, said collapsed portion being orthogonally positioned with respect to said alignment portion, each of said guide tabs being slidably positionable between said alignment portion and said collapsed portion of a respective one of said guide slots such that said first portion and said second portion of said body member are in said axially aligned position when said guide tabs of said first portion and said second portion of said body member are positioned in said alignment portion of said guide slots, said first portion and said second portion of said body member being in said axially parallel position when said guide tabs of said first portion and said second portion of said body member are positioned within said collapsed portion of said guide slots.

4. The collapsible toothbrush as set forth in claim 1, further comprising:

said base portion of said hinge member having a pair of locking pins, said locking pins being positioned between said channels of said hinge member;

said first portion and said second portion of said body member each having a locking tab, said locking tab of said first portion and said second portion of said body member having a locking aperture, said locking aperture of said locking tab of said first portion of said body member being for receiving one of said locking pins for securing said first portion in an axially aligned position, said locking aperture of said locking tab of said second portion of said body member being for receiving one of said locking pins for securing said second portion in an axially aligned position such that said first portion of said body member is aligned with said second portion of said body member when the user grips said body member for brushing the users teeth.

5. The collapsible toothbrush as set forth in claim 4, further comprising:

said hinge member having a center pin, said center pin being positioned between said locking pins of said hinge member, said center pin being adapted for being pushed upon by a finger of the user such that pushing of said center pin facilitates disengaging said locking pins from said locking tabs of said first portion and said second portion of said body member when said first portion and said second portion of said body member are pivoted to said axially parallel position.

6. The collapsible toothbrush as set forth in claim 1, further comprising:

said second portion of said body member having a cover member, said cover member being positioned opposite said first portion of said body member, said cover member being for receiving and protecting said bristles when said first portion of said body member is positioned adjacent said second portion of said body member.

7. The collapsible toothbrush as set forth in claim 6, further comprising:

said cover member of said second portion of said body member having a perimeter wall, said perimeter wall defining an interior cavity, said interior cavity having an open top for permitting insertion of said bristles into said interior cavity when said first portion of said body member is positioned adjacent said second portion of said body member.

8. The collapsible toothbrush as set forth in claim 7, further comprising:

said cover member of said second portion of said body member having a securing clip, said securing clip being coupled to said perimeter wall, said securing clip having a lip extending from an upper end of said securing clip, said lip extending into said interior cavity of said cover member, said lip of said securing clip being for engaging a rear face of said first portion of said body member when said bristles are inserted into said interior cavity of said cover member such that said securing clip selectively secures said first portion of said body member to said second portion of said of said body member when said first portion of said body member is positioned adjacent to said second portion of said body member.

9. The collapsible toothbrush as set forth in claim 8, further comprising:

said securing clip of said cover member having a finger tab, said finger tab upwardly extending from said upper end of said securing clip, said finger tab being adapted for being engaged by the user such that said securing clip is selectively bent away from said interior cavity thereby removing said lip of said securing clip from said interior cavity of said cover member for facilitating removal of said bristles from said cover member.

10. A collapsible toothbrush for aiding oral hygiene of the user, the collapsible toothbrush comprising:

a body member having a first portion and a second portion, said first portion being pivotally coupled to said second portion such that said first portion is selectively positionable adjacent said second portion facilitating compact storage of said body member, said first portion having a plurality of bristles, said bristles being adapted for being rubbed against teeth of the user for cleaning the teeth of the user, said bristles being positioned opposite said second portion of said body member such that said body member is adapted for being held in a hand of the user when said bristles are used to clean the teeth of the user;

wherein a hinge member being coupled between said first portion of said body member and said second portion of said body member, said first portion of said body member being pivotally coupled to said hinge member, said second portion of said body member being pivotally coupled to said hinge member such that said first portion of said body member is positionable adjacent said second portion of said body member when said first portion and said second portion of said body member are pivoted with respect to said hinge member;

wherein said hinge member having a base portion and a pair of side walls, said base portion and said side walls defining a pair of channels, said first portion of said body member being pivotally coupled within one of said channels of said hinge member, said second portion of said body member being pivotally coupled within one of said channels of said hinge member, said side walls of said hinge member being for maintaining alignment of said first portion and said second portion of said body member when said first portion and said second portion are pivoted with respect to said hinge member;

wherein each of said side walls of said hinge member having a pair of guide slots; and said first portion and said second portion of said body member each having a pair of guide tabs, each of said guide tabs being received by one of said guide slots receiving such that said guide slots are for guiding said first portion and said second portion of said body member between an axially aligned position and an axially parallel position when said first portion and said second portion of said body member are pivoted with respect to said hinge member;

wherein each of said guide slots having a alignment portion and a collapsed portion, said collapsed portion being orthogonally positioned with respect to said alignment portion, each of said guide tabs being slidably positionable between said alignment portion and said collapsed portion of a respective one of said guide slots such that said first portion and said second portion of said body member are in said axially aligned position when said guide tabs of said first portion and said second portion of said body member are positioned in said alignment portion of said guide slots, said first portion and said second portion of said body member being in said axially parallel position when said guide tabs of said first portion and said second portion of said body member are positioned within said collapsed portion of said guide slots;

wherein said base portion of said hinge member having a pair of locking pins, said locking pins being positioned between said channels of said hinge member;

said first portion and said second portion of said body member each having a locking tab, said locking tab of said first portion and said second portion of said body member having a locking aperture, said locking aperture of said locking tab of said first portion of said body member being for receiving one of said locking pins for securing said first portion in said axially aligned position, said locking aperture of said locking tab of said second portion of said body member being for receiving one of said locking pins for securing said second portion in said axially aligned position such that said first portion of said body member is aligned with said second portion of said body member when the user grips said body member for brushing the users teeth;

wherein said hinge member having a center pin, said center pin being positioned between said locking pins of said hinge member, said center pin being adapted for being pushed upon by a finger of the user such that pushing of said center pin facilitates disengaging said locking pins from said locking tabs of said first portion and said second portion of said body member when said first portion and said second portion of said body member are pivoted to said axially parallel position;

wherein said second portion of said body member having a cover member, said cover member being positioned opposite said first portion of said body member, said cover member being for receiving and protecting said bristles when said first portion of said body member is positioned adjacent said second portion of said body member;

wherein said cover member of said second portion of said body member having a perimeter wall, said perimeter wall defining an interior cavity, said interior cavity having an open top for permitting insertion of said bristles into said interior cavity when said first portion of said body member is positioned adjacent said second portion of said body member;

wherein said cover member of said second portion of said body member having a securing clip, said securing clip being coupled to said perimeter wall, said securing clip having a lip extending from an upper end of said securing clip, said lip extending into said interior cavity of said cover member, said lip of said securing clip being for engaging a rear face of said first portion of said body member when said bristles are inserted into said interior cavity of said cover member such that said securing clip selectively secures said first portion of said body member to said second portion of said of said body member when said first portion of said body member is positioned adjacent to said second portion of said body member;

wherein said securing clip of said cover member having a finger tab, said finger tab upwardly extending from said upper end of said securing clip, said finger tab being adapted for being engaged by the user such that said securing clip is selectively bent away from said interior cavity thereby removing said lip of said securing clip from said interior cavity of said cover member for facilitating removal said bristles from said cover member.

11. A collapsible toothbrush for aiding oral hygiene of the user, the collapsible toothbrush comprising:

a body member having a first portion and a second portion, said first portion being pivotally coupled to said second portion such that said first portion is selectively positionable adjacent said second portion facilitating compact storage of said body member, said first portion having a plurality of bristles, said bristles being adapted for being rubbed against teeth of the user for cleaning the teeth of the user, said bristles being positioned opposite said second portion of said body member such that said body member is adapted for being held in a hand of the user when said bristles are used to clean the teeth of the user;

said second portion of said body member having a cover member, said cover member being positioned opposite said first portion of said body member, said cover member being for receiving and protecting said bristles when said first portion of said body member is positioned adjacent said second portion of said body member;

said cover member of said second portion of said body member having a perimeter wall, said perimeter wall defining an interior cavity, said interior cavity having an open top for permitting insertion of said bristles into said interior cavity when said first portion of said body member is positioned adjacent said second portion of said body member; and said cover member of said second portion of said body member having a securing clip, said securing clip being coupled to said perimeter wall, said securing clip having a lip extending from an upper end of said securing clip, said lip extending into said interior cavity of said cover member, said lip of said securing clip being for engaging a rear face of said first portion of said body member when said bristles are inserted into said interior cavity of said cover member such that said securing clip selectively secures said first portion of said body member to said second portion of said of said body member when said first portion of said body member is positioned adjacent to said second portion of said body member.

12. The collapsible toothbrush as set forth in claim 11, further comprising:

said securing clip of said cover member having a finger tab, said finger tab upwardly extending from said upper end of said securing clip, said finger tab being adapted for being engaged by the user such that said securing clip is selectively bent away from said interior cavity thereby removing said lip of said securing clip from said interior cavity of said cover member for facilitating removal of said bristles from said cover member.

* * * * *